United States Patent [19]

Lewellin

[11] Patent Number: 4,678,822

[45] Date of Patent: Jul. 7, 1987

[54] RESIN IMPREGNATED FIBRE BATT

[75] Inventor: Richard L. Lewellin, Somerville, Australia

[73] Assignees: Maxwell Victor Lane; George Kaddis, both of Dandenong, Australia

[21] Appl. No.: 793,348

[22] Filed: Oct. 31, 1985

Related U.S. Application Data

[63] Continuation-in-part of Ser. No. 623,094, Jun. 21, 1984, abandoned.

[51] Int. Cl.[4] ..... C04B 43/00; C04B 43/12; C09K 3/28; A01N 25/34

[52] U.S. Cl. ..... 524/12; 524/437; 524/438; 524/514; 427/177; 428/288; 162/151; 162/152; 162/156; 162/157.1; 162/157.3; 162/157.4; 162/157.6; 162/159; 162/161

[58] Field of Search ..... 524/12, 437, 438, 514; 427/177; 428/288, 290, 402; 162/151, 152, 156, 157.1, 157.3, 157.4, 157.6, 159, 161

[56] References Cited

U.S. PATENT DOCUMENTS 2,054,131 9/1936 Kolleck ..... 524/12
2,527,628 10/1950 Francis, Jr. ..... 524/12
4,340,579 7/1982 Greber et al. ..... 524/430

FOREIGN PATENT DOCUMENTS

77826/81 11/1981 Australia .
0108567 9/1978 Japan .

*Primary Examiner*—John Kight
*Assistant Examiner*—Nathan M. Nutter
*Attorney, Agent, or Firm*—Fleit, Jacobson, Cohn & Price

[57] ABSTRACT

A bonded fibre insulation batt is produced by ragging, teasing and otherwise doffering fibres of wool and/or synthetic or other natural fibres such as monoacrylic, acrylic, polyamide, polyester or cotton fibres, so as to form a sliver with said fibres randomly dispersed. The sliver is passed through a lapper which causes the sliver to lap on itself to form a mat of desired thickness. The sliver is sprayed with a resin emulsion prior to lapping so that the mat produced is throughly impregnated. The resin emulsion can include a fireproofing resin, and preferably a pesticide and a smoke retardant. The impregnated mat passes to a dryer to remove a substantial part of the water content thereof with minimal heating of the fibres. Following the water removal the mat passes to an oven to cure the resin thus forming the insulating batt which can be cut to desired size.

12 Claims, No Drawings

RESIN IMPREGNATED FIBRE BATT

This is a continuation-in-part of U.S. application Ser. No. 623,094 filed June 21, 1984.

BACKGROUND OF THE INVENTION

The present invention relates to improvements in insulation, and in particular to the use of bonded monoacrylic, acrylic or polyamide, polyester and like synthetic or cellulose fibres either alone or in combination with animal fibres and either in batt form or as 'blow in' insulation.

With the present energy costs, conservation of heat is highly desirable. One method of conserving heat in the domestic scene is to insulate the dwelling. Fibreglass insulation is used extensively in this field, although it is hazardous to health, and difficult to handle in batts by reason of the glass fibres. Use of chemicals to render 'blow in' fibreglass fire-retarding is also health hazardous.

BACKGROUND ART

In the Australian Pat. No. 527,843 granted to Richard L. Lewellin there is disclosed a method of forming an insulation batt of bonded fibres, at least 95% of which are wool fibres. The method involves ragging and teasing wool fibres of waste wool, wool seconds and the like, and matting the randomly dispersed wool fibres to produce a batt of the required thickness. The batt is then sprayed with fire retardant, resins, pesticides, etc. and the resins are set by curing.

However, it is often difficult to obtain waste products having a high wool content. It has been found, however, that other fibres, when suitably treated and formed into a batt, will bond together and with wool fibres to enable a suitable insulating batt to be formed.

Accordingly, it is an object of the invention to provide an improved method of producing an insulating batt or an insulating loose material formed of waste textile and other materials which do not necessarily include a high amount of wool fibres.

A further object of the present invention is to provide an insulation which is not hazardous to the health, but yet has all the properties of existing insulation.

SUMMARY OF THE INVENTION

Accordingly, the present invention provides a method of forming a batt of bonded fibres for use as insulation, said fibres comprising monoacrylic, acrylic or other synthetic or cellulose fibres with from 0 to 95% wool fibres, said batt being formed by ragging, teasing and otherwise doffering the fibres of waste textile and other materials to form a randomly dispersed fibre sliver, passing said sliver through a lapper and, while maintaining a resin emulsion spray means a predetermined distance from said sliver, spraying said sliver with a resin emulsion which preferably includes one or more of a fire-proofing resin, a smoke retardant and pesticide, to thereby form a mat of predetermined thickness of the resin emulsion impregnated sliver, evaporating or otherwise removing up to about 80%, and preferably 50%, of the water from the mat without substantial heating of the mat, subsequently setting the resins by curing, and cutting the mat to form batts of desired length.

The bonded fibres have a plurality of air pockets which assists in the insulation effect. If desired for a 'blow in' installation, the batts may be broken down into small balls of bonded fibre in loose form.

Use of wool fibres in amounts between 25% and 60% of total fibres is preferred having regard to the known fire-retardant properties of wool. In addition, it is rot proof and vermin proof. As the insulation is not visible in the finished installation, it is possible to make use of wool 'seconds', especially black fleeces, cuttings from the shearing sheds and recycled woollen jumpers and other garments.

Other fibres which are combined with the wool fibres and which are particularly useful in the invention include monoacrylic, acrylic, polyamide and polyester synthetic fibres as well as other natural fibres such as cotton. These types of fibres, when matted and bonded together in a batt, preferably with additional wool fibres, results in an insulation material which is extremely economical to produce, which can be formed of waste clothing and other waste materials and which has excellent insulating properties without the hazards of other known insulating products.

It has been found that by spraying the resins onto the relatively thin sliver of dispersed fibre immediately the sliver passes from the lapper but before matting ensures that the resins completely penetrate the material so that the mat subsequently formed is completely impregnated.

Wool and other fibres are affected by heat and become soft and less resilient. Because of the water content of the resin emulsion, up to 75% by weight, and the heat required to cure the resins, the impregnated mat may collapse and shrink when subjected to the external heating source required to cure the resins. The mat is therefore treated prior to the curing step to remove up to 80% of the water in a manner which obviates or reduces the heating effect on the fibres and resin. Preferably the water removal treatment is carried out by dielectric heating. However, other substantially non-heating treatments may also be used.

Resins suitable for use in the present invention include flame depressants such as modified acrylic self-crosslinking polymers such as Rhoplex HA-20, available from Rohn & Haas. Other additives to the spray include Aluminium Trihydrate and Kem Gard (Trade Mark) (I.C.I. smoke suppressant) and Perigen (Trade Mark) (a pesticide) especially suitable against clothes moths and carpet beetle and available from Burroughs Wellcome.

The insulation so formed may be used in any location i.e. in home, office, factory or other building, for either heat or acoustic insulation.

In order that the invention may be more clearly understood, a preferred embodiment thereof will now be described.

DESCRIPTION OF PREFERRED EMBODIMENT

A mixture of ragged acrylic and cotton garments and new wool is fed to a doffer, or carding machine, which separates the fibres and teases them to form a sliver or relatively thin web of randomly dispersed fibres, comprising 50% acrylic and cotton fibres and 50% wool fibres. The sliver has a thickness of about ⅛ inch. The sliver is fed from the doffer, or carding machine, onto a horizontal lapper which oscillates at a predetermined rate to deliver the sliver to a conveyor where the sliver is lapped onto itself to build up a mat of a predetermined thickness.

Before the sliver leaving the lapper engages on the conveyor, or on to previously lapped material on the conveyor, it is sprayed with an emulsion of resins comprising Rhoplex Resin, Aluminium Trihydrate and Perigen pesticide. The water content of the emulsion is approximately 54% by weight.

A spray boom having a plurality of spray nozzles for spraying the resin emulsion is mounted adjacent the lapper and is connected thereto by a linkage system which maintains the boom a predetermined distance from the material sliver moving from the lapper towards the conveyor. The linkage system causes the boom to move with the lapper but through a distance related to the actual sliver movement which, because of the oscillating lapper movement and the distance between the lower end of the lapper and the conveyor, is different than the actual lapper movement.

A second boom positioned on the opposite side of the sliver to the spray boom is fed with air to produce an air cushion to thereby balance the forces produced by the resin emulsion spray and maintain the sliver in its correct alignment with the conveyor.

The mat formed of the lapped sliver, which is thoroughly impregnated with the resin emulsion sprayed onto the sliver, is conveyed to a dielectric drying station and passes between spaced plate electrodes which are electrically charged by high frequency a.c. potential. The frequency and voltage applied to the plate electrodes are chosen to optimize drying of the mat with minimum heating of the fibres. Approximately 50% of the water content is removed at the drying station.

The mat is then conveyed to a curing oven heated to about 150° C. to complete the drying and to cure the resins to form a relatively rigid but resilient insulating mat material. When the batt emerges from the oven, it is cut into suitable lengths, or rolled in a long length, as required.

A batt formed in the above manner, gave the following results:

Sample Description:

Insulation batts composition:

Wool—nominal—50% W/W

Acrylic and Cotton—nominal 50% W/W

Rhoplex Resin—nominal 25–42 g/m$^2$ (ex Rhom & Haas—Rhoplex HA/20)

Flame retardant: Aluminium Trihydrate (ex Alcoa)

Thickness: Nominal 68 mm

Fire Rating Test—Standard Method

Australian Standard 1530.3.1976

| TEST DESCRIPTION EARLY FIRE HAZARD PROPERTIES OF MATERIALS | RESULT | UNIT |
|---|---|---|
| Ignitability Index | 0 | Range 0–20 |
| Spread of Flame Index | 0 | Range 0–10 |
| Heat Evolved Index | 0 | Range 0–10 |
| Smoke Developed Index | 6 | Range 0–10 |

Comments on Tests

For the test each specimen had a backing of 4.5 mm thick Fire Resistant board and was restrained by a layer of approx. 0.8 mm diameter square wire mesh having a spacing of approx. 12 mm in each direction.

| Measurement of Thermal Resistance | |
|---|---|
| Thickness (mm) | 53.5 |
| Density (kg/m$^3$) | 25 |
| Moisture content (%) | 9 |
| Hot plate temperature (°C.) | 35.6 |
| Cold plate temperature (°C.) | 15.7 |
| Temperature difference (k) | 19.9 |
| Mean temperature (°C.) | 25.7 |
| Thermal resistance (m$^2$k/w) | 1.34 |
| Thermal conductivity (W/mK) | 0.400 |

From the foregoing it will be seen that wool, synthetic and other natural fibres are bonded together to form an insulation batt which may then be installed in a desired location. Alternatively, the batt may be broken down into small balls which are blown or otherwise spread over the desired location, again to provide insulation. By reason of the inherent insulating properties of the wool, synthetic and other natural fibres, particularly when matted, the batt thickness is considerably less than the thickness of the fibreglass batt of comparable heat insulation.

Thus the present invention provides a means of insulation that avoids the health hazards of the existing insulation, which is able to use discarded or second-grade wool fleeces, thereby improving the farmers' economic return on his flock, and yet the insulation so produced is equal to that which it is to replace. In addition, discarded wool, synthetic and other natural fibres, or wool, synthetic and other natural fibre garments may be ragged and used in the present invention, again reducing the cost of raw materials.

Although use of an oven has been described for curing the sprayed resins, other curing methods may be used, including electron beam irradiation.

Similarly, although the preferred chemical reagents and resins have been described, other reagents and resins may be used, provided they are compatible with each other and with the fibres.

In some forms of batt made with soft or light fibres or fibres which have no resiliency, if the resins used do not add sufficient stiffness to the batt it is likely to collapse inwardly over time thus reducing the insulating properties. Accordingly, the resins used should preferably be selected to ensure the batt retains its bulk and structural integrity. If desired, a stiffening agent, such as starch, resin stiffeners or similar agents, can be added to the batt either by incorporating the stiffening agent into the resin emulsion or by separately spraying the sliver or the mat.

I claim:

1. A method for forming a batt of bonded fibers for use as thermal insulation, which comprises the steps of:

(a) ragging, teasing and doffering fibers which include from an amount from 0 to 95% wool, together with fibers selected from the group consisting of monoacrylic, acrylic, polyamide, polyester and natural fibers;

(b) forming a sliver of randomly dispersed fibers;

(c) feeding the sliver onto a lapper;

(d) oscillating the lapper at a rate which will deliver the sliver to a conveyor on which the sliver is lapped into a multi-layered matt;

(e) oscillating a spray boom in sequence with the oscillating sliver to maintain the spray boom at the same distance from said sliver at all times as the sliver is delivered from the lapper;

(f) providing a second boom, which emits a cushion of air against said sliver on the side of said sliver opposite said spray boom to maintain the sliver in correct alignment with the conveyor;

(g) supplying a resin-emulsion comprising a fireproofing resin, a smoke retardant and pesticide to said spray boom;

(h) spraying said oscillating sliver with said resin-emulsion so that the matt formed by the lapped sliver is thoroughly impregnated with said resin-emulsion, (i) conveying the impregnated matt to a drying means;

(j) evaporating or removing up to 80% of the water content of said matt while maintaining the temperature of the matt below the minimum temperature at which the fiber is substantially unimpaired by heat;

(k) curing the resin content of the matt to form a substantially rigid matt; and (l) cutting the matt to form batts of desired length.

2. The method according to claim 1 including the step of supporting said sliver on an air cushion against the force exerted on said sliver when spraying said resin-emulsion onto said sliver.

3. The method according to claim 1 where said evaporating step includes passing said mat between spaced plate electrodes of a dielectric dryer and applying an A.C. voltage to the plates at a high frequency.

4. The method according to claim 1 wherein said evaporating step removes approximately 50% of water from a resin-emulsion which contains between 35% and 60% water by weight.

5. The method according to claim 1 including the step of adding a stiffening agent to said sliver.

6. The method according to claim 5 where said stiffening agent is incorporated in said resin-emulsion.

7. The method according to claim 5 where said stiffening agent is sprayed onto said sliver after said sliver has lapped on itself to form a mat.

8. The method according to claim 1 where said forming step forms fibers comprising 25% to 50% wool fibers.

9. The method according to claim 1 where said curing stop is accomplished by heating the mat in an oven at a temperature of approximately 150° C.

10. The method according to claim 1 wherein said spraying step comprises spraying a modified acrylic self-crosslinking polymer onto said sliver.

11. The method according to claim 1 wherein said spraying step comprises spraying a resin-emulsion containing aluminum trihydrate as said smoke-retardant onto said sliver.

12. The method according to claim 1 including the step of breaking down said insulating batt into small balls of bonded fibers.

* * * * *